US007803001B2

(12) United States Patent
Wason

(10) Patent No.: US 7,803,001 B2
(45) Date of Patent: Sep. 28, 2010

(54) GROUND CONNECTOR

(75) Inventor: Peter M. Wason, Hudson, NH (US)

(73) Assignee: Burndy Technology, LLC, Manchester, NH (US)

( * ) Notice: Subject to any disclaimer, the term of this patent is extended or adjusted under 35 U.S.C. 154(b) by 0 days.

(21) Appl. No.: 12/316,472

(22) Filed: Dec. 10, 2008

(65) Prior Publication Data

US 2010/0144173 A1 Jun. 10, 2010

(51) Int. Cl.
*H01R 4/66* (2006.01)

(52) U.S. Cl. ..... 439/100

(58) Field of Classification Search ..... 439/100, 439/92, 804; 24/277
See application file for complete search history.

(56) References Cited

U.S. PATENT DOCUMENTS 2,942,898 A 6/1960 Matthysse
3,727,266 A * 4/1973 Ashworth ..... 16/253
4,079,487 A * 3/1978 Coop, Sr. ..... 24/277
4,114,977 A 9/1978 Polidori ..... 339/270
5,286,211 A 2/1994 McIntosh ..... 439/100

OTHER PUBLICATIONS

"Burndy Products" Catalog, pp. D27-D31, FCI USA Inc., 2000.

* cited by examiner

*Primary Examiner*—Phuong K Dinh
(74) *Attorney, Agent, or Firm*—Harrington & Smith

(57) ABSTRACT

A ground connector including a frame and a U-bolt. The frame has a first conductor contact surface and a second conductor contact surface. The first and second conductor contact surfaces are angled relative to each other. The U-bolt has ends configured to extend through portions of the frame. The U-bolt and the frame are configured to directly contact and clamp a member therebetween.

17 Claims, 5 Drawing Sheets

GROUND CONNECTOR

BACKGROUND OF THE INVENTION

1. Field of the Invention

The invention relates to an electrical connector and, more particularly, to a ground connector.

2. Brief Description of Prior Developments

U.S. Pat. No. 5,286,211 discloses a ground connector where conductors can be clamped directly against a post in two orthogonal orientations. It is known in raised floor structures, used in a building having numerous computer or telephone or electrical devices, to provide a grounding network. The grounding network can comprise ground conductors or cables arranged in a parallel grid or a perpendicular grid. A ground connector is used to connect the cable to a post or pedestal of the raised floor system.

There is a desire to provide a ground connector which can be used to connect a ground cable, of either a parallel grid or a perpendicular grid, to a post or pedestal.

SUMMARY

The following summary is merely intended to be exemplary. The summary is not intended to limit the scope of the claimed invention.

In accordance with one aspect of the invention, a ground connector is provided including a frame and a U-bolt. The frame has a first conductor contact surface and a second conductor contact surface. The first and second conductor contact surfaces are angled relative to each other. The U-bolt has ends configured to extend through portions of the frame. The U-bolt and the frame are configured to directly contact and clamp a member therebetween.

In accordance with another aspect of the invention, a ground connector is provided comprising a frame, a first jaw and a second jaw. The frame has a first conductor contact surface and a second conductor contact surface. The first and second conductor contact surfaces are substantially orthogonal to each other. The frame has a general right angle shape with the first and second conductor contact surfaces located on respective first and second outer sides of the general right angle shape. An inner side of the general right angle shape is configured to contact another member when the frame is clamped against the member. The first jaw is located opposite the first outer side. The second jaw is located opposite the second outer side. The first and second jaws are respectively configured to clamp a first or second conductor against the respective first and second outer sides of the frame.

In accordance with another aspect of the invention, a method is provided comprising clamping a ground connector frame to a member with a U-bolt, wherein the frame directly contacts the member; and clamping an electrical conductor against the frame by either a first clamp located opposite a first outwardly facing side of the frame or a second clamp located opposite a second outwardly facing side of the frame. The first and second clamps are connected to the frame by opposite legs of the U-bolt. The first and second sides are generally orthogonal to each other.

In accordance with another aspect of the invention, a method is provided comprising forming a frame having a general V shape with two legs which are angled relative to each other, wherein an inner side general V shape is configured to contact another member when the frame is clamped against the member; providing a U-bolt, wherein opposite legs of the U-bolt are configured to pass through respective ones of the legs of the frame such that the U-bolt and the frame are configured to clamp the member therebetween; and providing first and second clamps configured to be connected to respective ones of the legs of the frame by the opposite legs of the U-bolt. The frame and the first clamp are configured to directly contact and clamp a conductor against an outward facing surface of a first one of the legs of the frame. The frame and the second clamp are configured directly contact and clamp a conductor against an outward facing surface of a second one of the legs of the frame.

BRIEF DESCRIPTION OF THE DRAWINGS

The foregoing aspects and other features of the invention are explained in the following description, taken in connection with the accompanying drawings, wherein.

DETAILED DESCRIPTION OF EMBODIMENT

Figure 1:
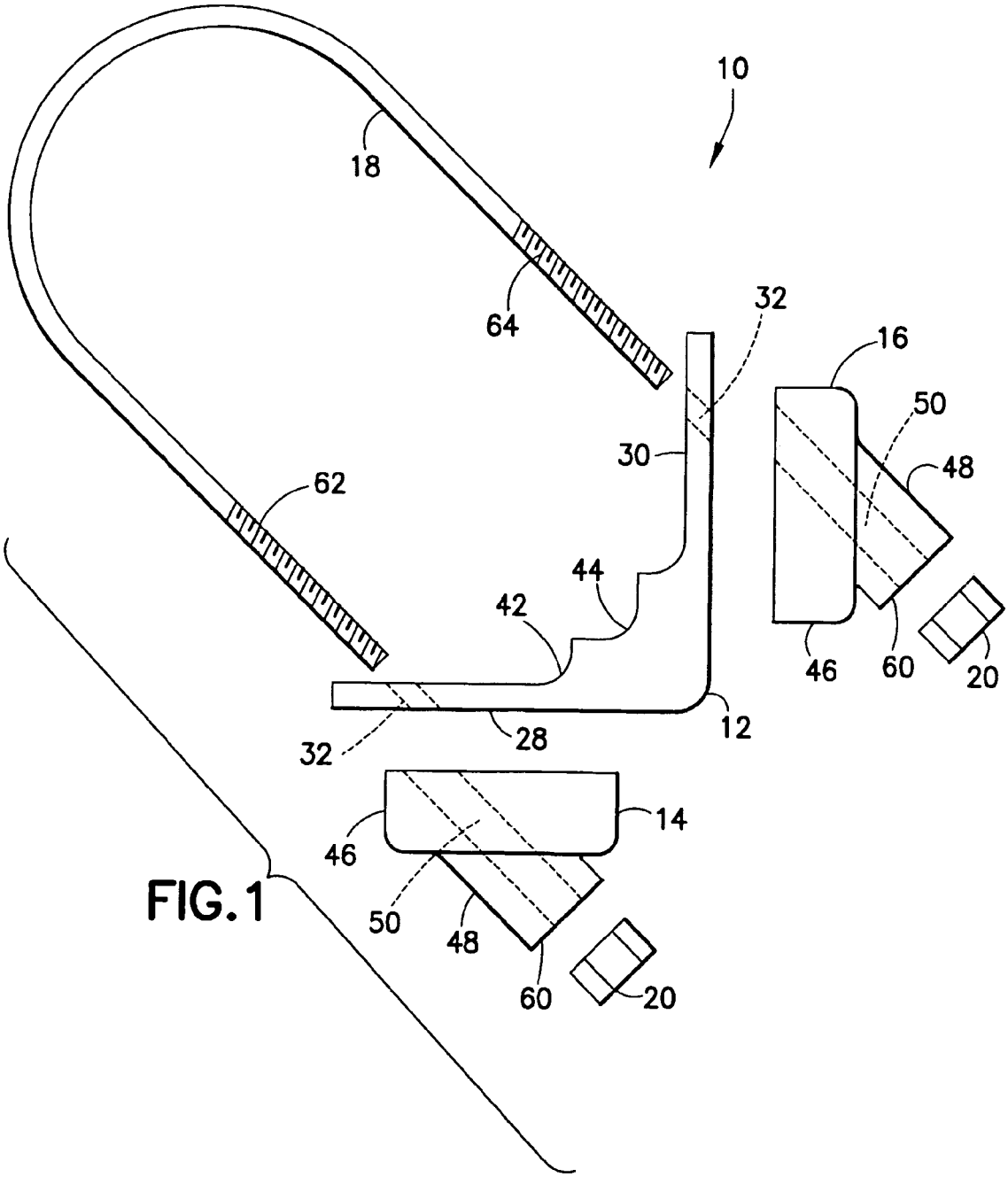
FIG. 1 is an exploded top plan view of an electrical connector comprising features of the invention.

Referring to FIG. 1, there is shown an exploded view of an electrical connector 10 incorporating features of the invention. Although the invention will be described with reference to the example embodiment shown in the drawings, it should be understood that the invention can be embodied in many alternate forms of embodiments. In addition, any suitable size, shape or type of elements or materials could be used.

Figure 2:
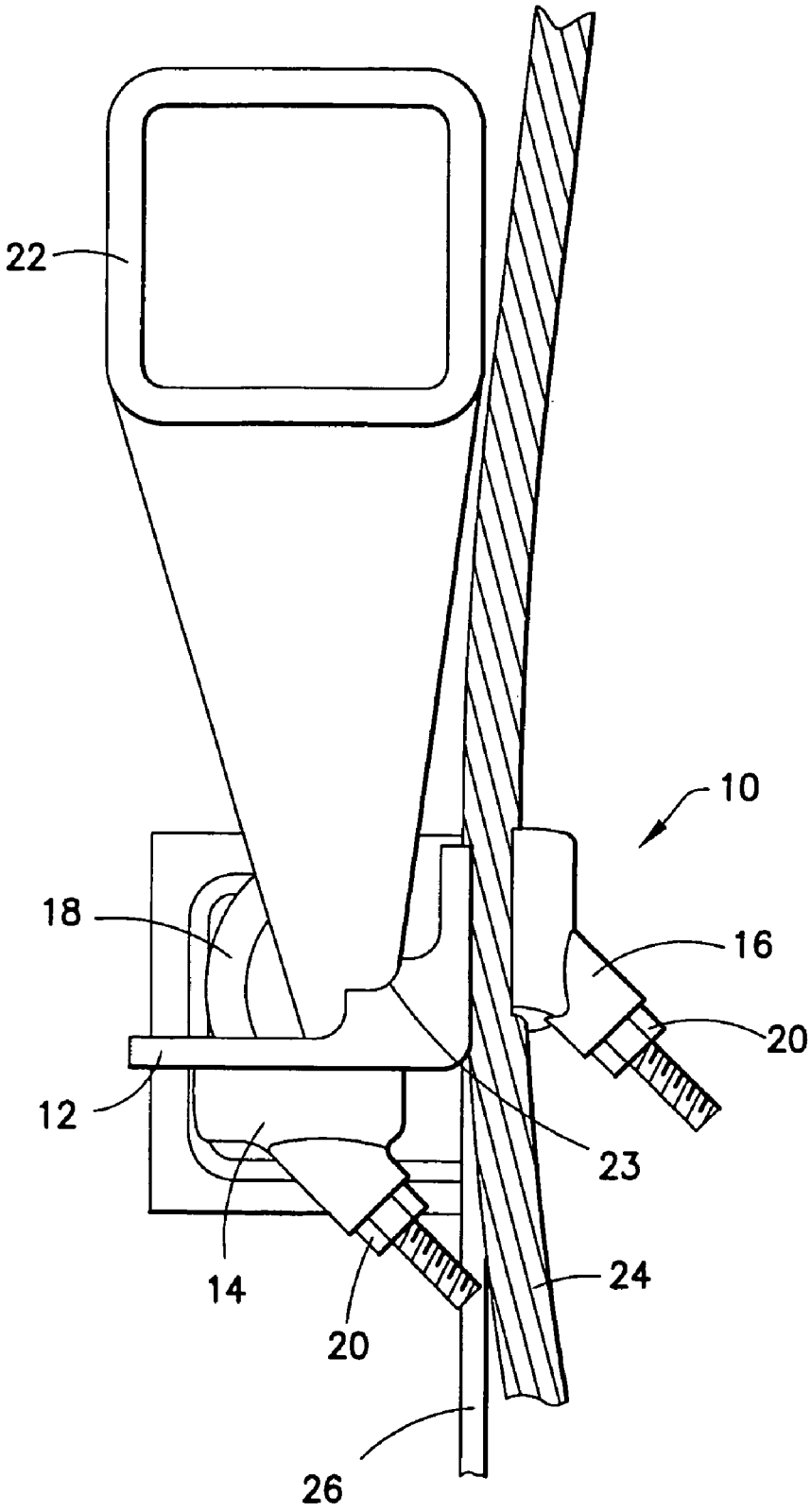
FIG. 2 is a perspective view of the connector shown in FIG. 1 shown attached to a post and two conductors in a parallel grid grounding network.
Figure 3:
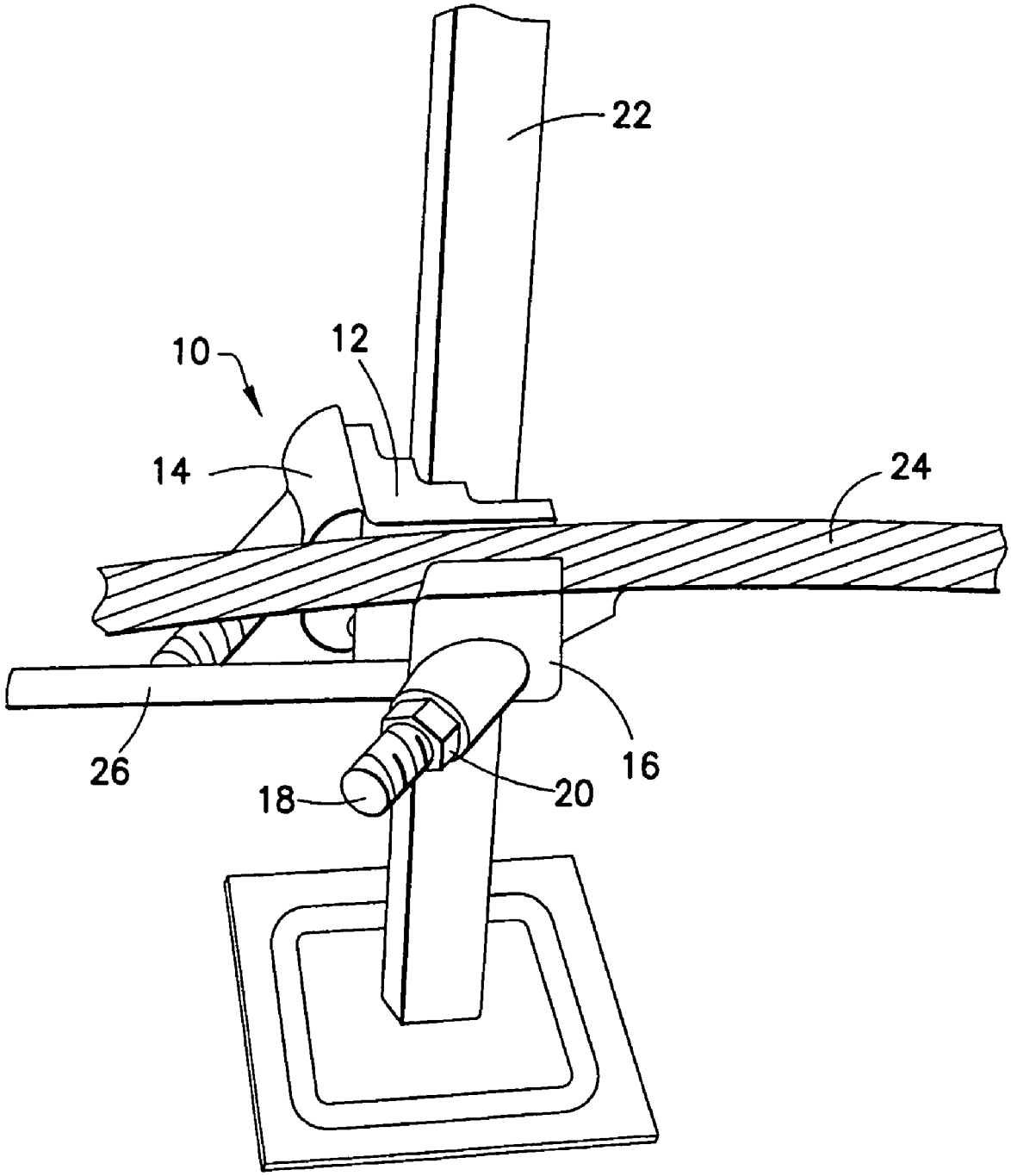
FIG. 3 is a perspective view of the members shown in FIG. 2 from another angle.

The connector 10 is a ground connector. However, features of the invention could be used in any suitable type of electrical connector. The connector 10 generally comprises a frame 12, two jaws 14, 16, a U-bolt 18 two nuts 20 and two lock washers. Referring also to FIGS. 2 and 3, the ground connector 10 is configured to attach to another member 22 and electrically connect two conductors 24, 26 to each other. In the embodiment shown, the member 22 is a post or pedestal used as part of a raised floor system. In one embodiment of the connector of the invention, the connector is sized and shaped to fit onto a pedestal between ⅞ inch square and 2 inch round; as opposed to conventional connectors which could only fit onto a pedestal between ⅞ inch square and 1 inch round. Also, the size range of the connector is larger than a conventional connector: #6 solid—4/0 stranded instead of #4-#8. However, the connector 10 could be used in other environments and be connected to another type of member or conductor sizes. The two conductors 24, 26 are ground cables. The connector 10 is used to connect the conductors 24, 26 to each other.

Figure 4:
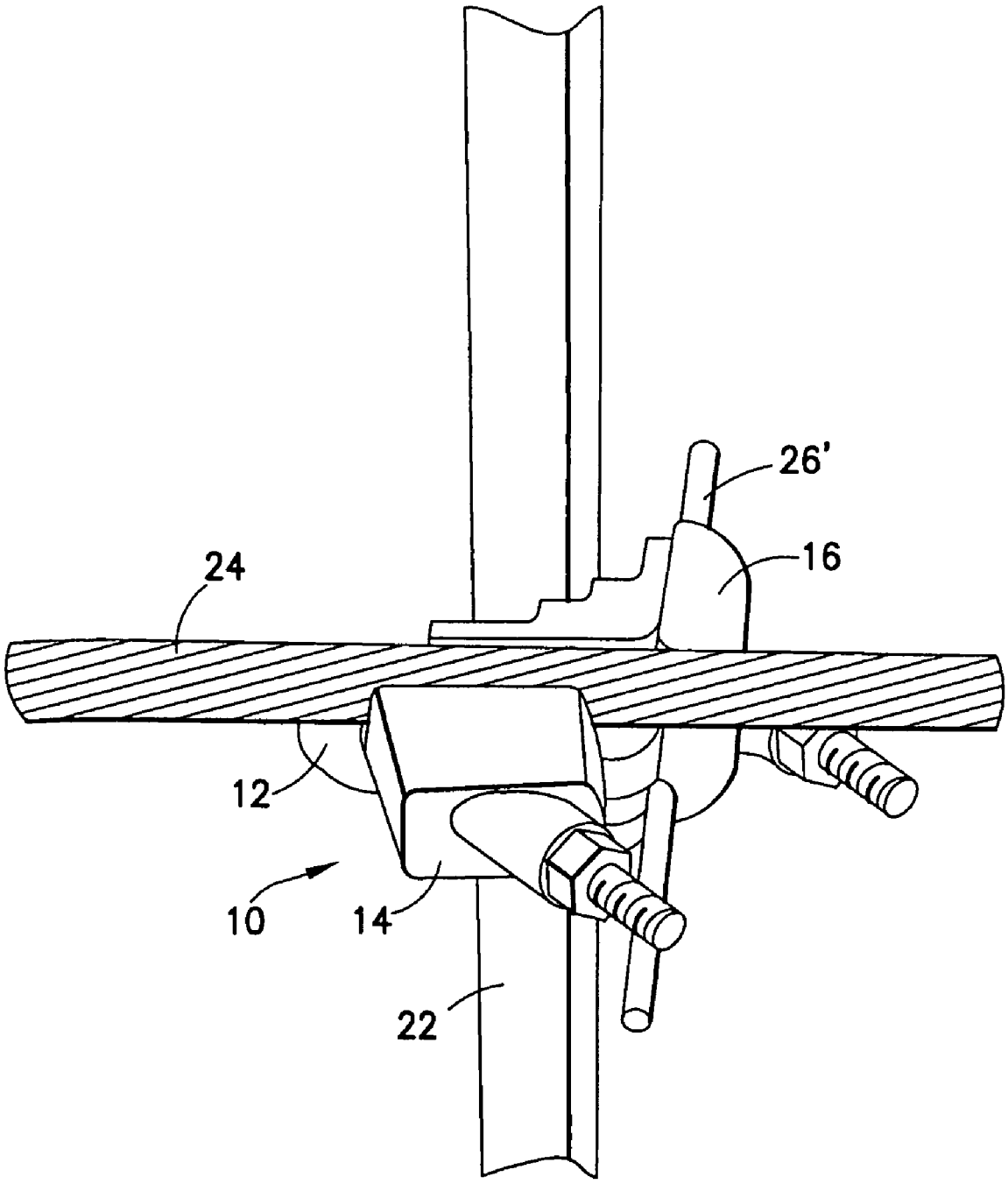
FIG. 4 is a perspective view of the connector shown in FIG. 1 attached to the post and two conductors in a perpendicular grid grounding network.

In the embodiment shown, the U-bolt 18 and the frame 12 are configured to clamp the post 22 therebetween, and thereby mount the connector 10 onto the post 22. The U-bolt 18 also connects the clamps 14, 16 to the frame 12 to thereby clamp the conductors 24, 26 to the frame 12. FIGS. 2-3 show use of the connector in a parallel grid grounding network wherein the conductor cables 24, 26 are parallel to each other. FIG. 4 shows the same connector 10 being used to connect the cables 24, 26' in a perpendicular grid grounding network wherein the conductor cables 24, 26' are perpendicular to each other.

Figure 5:
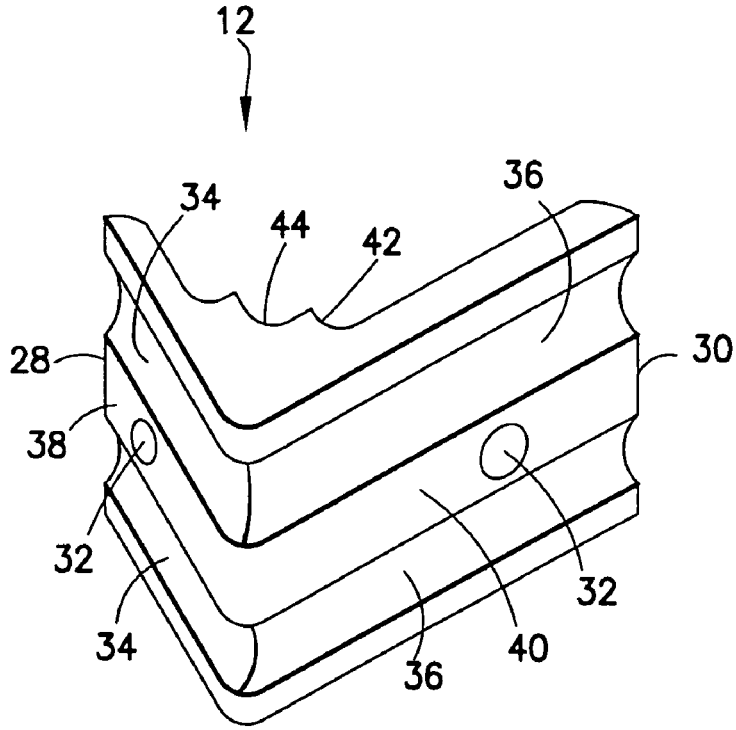
FIG. 5 is a perspective view of the frame shown in FIG. 1.

Referring also to FIG. 5, the frame 12 is preferably a one-piece member comprised of metal, such as cast metal for example. The frame 12 has a general right angle shape or general V shape. The frame 12 has a first leg 28 and a second leg 30. The second leg 30 is angled relative to the first leg 28 at an angle of about 90 degrees. The two legs 28, 30 each have an angled hole 32 therethrough. The holes 32 are parallel to each other. The first leg 28 has two conductor contact surfaces 34 located on its exterior side 38. The second leg 30 has two conductor contact surfaces 36 located on its exterior side 40. The exterior sides 38, 40 are generally orthogonal to each other. In this embodiment the conductor contact surfaces 34, 36 are grooves along the outwardly facing sides 38, 40. The holes 32 are located between the conductor contact surfaces 34, 36 on each side. The inner side 42 of the frame 12 has a contact and mounting surface 44 which is sized and shaped to contact and mount against the post 22; in this embodiment a corner 23 of the post (see FIG. 2).

Figure 6:
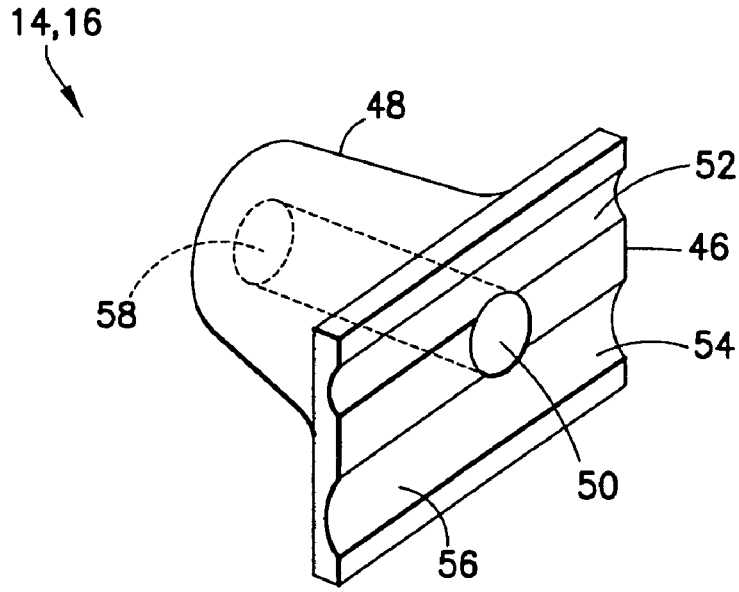
FIG. 6 is a perspective view of the clamps shown in FIG. 1.

Referring also to FIG. 6, the first and second clamps 14, 16 are identical to each other; merely orientated orthogonally flipped relative to each other (see FIG. 1). Each clamp 14, 16 is preferably a one-piece member comprised of metal, such as cast metal for example. Each clamp 14, 16 has a first section 46 and a second section 48. A through hole 50 extends through the two sections 46, 48. The first section 46 has an exterior side 56 with two conductor contact surfaces 52, 54. The entrance to the hole 50 is located generally between the two surfaces 52, 54. The second section 48 extends away from the first section 46 at an angle. In this embodiment the second section has a general tubular shape. The exit 58 of the hole 50 is at the end of the second section 46. The surface of the second section around the exit 58 forms a seat 60 for the lock washers and nuts 20.

The U-blot 18 has two legs 62, 64 with threads. The nuts 20 and lock washers are sized to attach to the threaded legs 62, 64. When the components are assembled, the U-bolt 18 and nuts 20 can clamp the clamps 14, 16 towards the legs 28, 30 to thereby clamp the conductors 24, 26 between the clamps 14 and/or 16 and the frame 12. At the same time, the member 22 is clamped between the U-bolt 18 and the frame 12.

With the invention, a ground connector 10 can be provided comprising a frame 12 having a first conductor contact surface 34 and a second conductor contact surface 36. The first and second conductor contact surfaces 34, 36 are angled relative to each other. A U-bolt 18 is provided having ends configured to extend through portions of the frame. The U-bolt and the frame are configured to directly contact and clamp a member 22 therebetween. The frame is preferably a one-piece metal member having a generally right angle shape with a first leg 28 angled relative to a second leg 30. The first and second conductor contact surfaces 34, 36 are located on outwardly facing sides of the respective first and second legs. The first leg 28 comprises two of the first conductor contact surfaces 34 which are parallel to each other, and a first leg 62 of the U-bolt 18 extends through the frame in a space between the two first conductor contact surfaces 34. The second leg 30 comprises two of the second conductor contact surfaces 36 which are parallel to each other, and a second leg 64 of the U-bolt 18 extends through the frame in a space between the two second conductor contact surfaces. A first jaw 14 is connected to the frame by the first leg 62 of the U-bolt. The first jaw 14 is located directly opposite the first conductor contact surface 34 to clamp a first conductor directly against the first conductor contact surface. A second jaw 16 is connected to the frame by a second opposite leg 64 of the U-bolt, wherein the second jaw is located directly opposite the second conductor contact surface 36 to clamp a second conductor directly against the second conductor contact surface. The first jaw 14 comprises a first section 46 having a conductor contact surface 52, 54 and a second section 48 extending away from the first section at an angle. A through hole 50 extends through the first and second sections, and the first leg 62 of the U-bolt is located in the through hole.

As another description of the example embodiment, a ground connector 10 is provided comprising a frame 12 having a first conductor contact surface 34 and a second conductor contact surface 36, wherein the first and second conductor contact surfaces are substantially orthogonal to each other, wherein the frame 12 has a general right angle shape with the first and second conductor contact surfaces located on respective first and second outer sides 38, 40 of the general right angle shape. An inner side 42 of the general right angle shape is configured to contact another member 22 when the frame is clamped against the member. A first jaw 14 is located opposite the first outer side 38. A second jaw 16 located opposite the second outer side 40. The first and second jaws 14, 16 are respectively configured to clamp a first or second conductor against the respective first and second outer sides of the frame.

A method of the invention comprises clamping a ground connector frame 12 to a member 22 with a U-bolt 18, wherein the frame 12 directly contacts the member 22; and clamping an electrical conductor 24 and/or 26 against the frame 12 by either a first clamp 14 located opposite a first outwardly facing side 38 of the frame or a second clamp 16 located opposite a second outwardly facing side 40 of the frame, wherein the first and second clamps are connected to the frame by opposite legs 62, 64 of the U-bolt 18, and wherein the first and second sides 38, 40 are generally orthogonal to each other.

A method of the invention comprises forming a frame 12 having a general V shape with two legs 28, 30 which are angled relative to each other, wherein an inner side 42 of the general V shape is configured to contact another member 22 when the frame is clamped against the member; providing a U-bolt 18, wherein opposite legs 62, 64 of the U-bolt are configured to pass through respective ones of the legs 28, 30 of the frame 12 such that the U-bolt and the frame are configured to clamp the member 22 therebetween; and providing first and second clamps 14, 16 configured to be connected to respective ones of the legs 28, 30 of the frame by the opposite legs 62, 64 of the U-bolt, wherein the frame and the first clamp are configured to directly contact and clamp a conductor 24 and/or 26 against an outward facing surface of a first one of the legs 28 of the frame, and the frame and the second clamp are configured directly contact and clamp a conductor 24 and/or 26 against an outward facing surface of a second one of the legs 30 of the frame.

Unlike the connector shown in U.S. Pat. No. 5,286,211, a connector incorporation features of the invention Can have an addition of a second part (the frame 12) which is located in between the pedestal post 22 and the conductors 24, 26. Its function is two fold: 1) it allows for a larger pedestal and wire range, and 2) it creates more stability by keeping a line of contact with the pedestal post.

Unlike the connector shown in U.S. Pat. No. 5,286,211 the new connector does not need to attach with a clamp block; there is a mechanism that hooks around the pedestal and attaches to the other side of the connector. Unlike the connector shown in U.S. Pat. No. 5,286,211 (which describes how one end of the connector can accommodate a few different pedestal sizes by having a primary and secondary groove, specifically 90 degree and 135 degree, respectively) the new connector can have a 90 degree primary groove followed by a round surface on either size, so the "secondary groove" can have a range of 90 degrees to 170 degrees.

It should be understood that the foregoing description is only illustrative of the invention. Various alternatives and modifications can be devised by those skilled in the art without departing from the invention. For example, features recited in the various dependent claims could be combined with each other in any suitable combination(s). In addition, features from different embodiments described above could be selectively combined into a new embodiment. Accordingly, the invention is intended to embrace all such alternatives, modifications and variances which fall within the scope of the appended claims.

What is claimed is:

1. A ground connector comprising:

a frame having a first electrical conductor contact surface comprising a first recess adapted to receive a portion of a first electrical ground conductor and a second electrical conductor contact surface comprising a second recess adapted to receive a portion of a second electrical ground conductor, wherein the first and second conductor contact surfaces are angled relative to each other; and a U-bolt having ends configured to extend through portions of the frame, wherein the U-bolt and the frame are configured to directly contact and clamp a member therebetween.

2. A ground connector as in claim 1 wherein the frame is a one-piece metal member having a generally right angle shape with a first leg angled relative to a second leg.

3. A ground connector as in claim 2 wherein the first and second conductor contact surfaces are located on outwardly facing sides of the respective first and second legs opposite an inner facing side of the frame adapted to contact the member.

4. A ground connector as in claim 3 wherein the first leg comprises two of the first conductor contact surfaces which are parallel to each other, and wherein a first leg of the U-bolt extends through the frame in a space between the two first conductor contact surfaces.

5. A ground connector as in claim 4 wherein the second leg comprises two of the second conductor contact surfaces which are parallel to each other, and wherein a second leg of the U-bolt extends through the frame in a space between the two second conductor contact surfaces.

6. A ground connector as in claim 1 further comprising a first jaw connected to the frame by a first leg of the U-bolt, wherein the first jaw is located directly opposite the first conductor contact surface to clamp the first conductor directly between the first conductor contact surface and the first jaw.

7. A ground connector as in claim 6 further comprising a second jaw connected to the frame by a second opposite leg of the U-bolt, wherein the second jaw is located directly opposite the second conductor contact surface to clamp the second conductor directly between the second conductor contact surface and the second jaw.

8. A ground connector as in claim 6 wherein the first jaw comprises a first section having a conductor contact surface and a second section extending away from the first section at an angle, wherein a through hole extends through the first and second sections, and wherein the first leg of the U-bolt is located in the through hole.

9. A ground connector comprising:

a frame having a first conductor contact surface and a second conductor contact surface, wherein the first and second conductor contact surfaces are substantially orthogonal to each other, wherein the frame has a general right angle shape with the first and second conductor contact surfaces located on respective first and second outer sides of the general right angle shape, and wherein an inner side of the general right angle shape is configured to contact another member when the frame is clamped against the member;

a first jaw located opposite the first outer side; and a second jaw located opposite the second outer side, wherein the conductor contact surfaces of the frame and/or the jaws comprise a recess adapted to receive at least one electrical ground conductor, wherein the first and second jaws are configured to clamp the at least one conductor against at least one of the outer sides of the frame in the recess(s).

10. A ground connector as in claim 9 further comprising a U-bolt having opposite legs respectively connecting the first and second jaws to the frame.

11. A ground connector as in claim 9 wherein the frame is a one-piece metal member having a V shape with a first leg angled relative to a second leg.

12. A ground connector as in claim 11 wherein the first leg of the frame comprises two of the first conductor contact surfaces which are parallel to each other, and wherein a fastener hole extends through the frame in a space between the two first conductor contact surfaces.

13. A ground connector as in claim 12 wherein the second leg of the frame comprises two of the second conductor contact surfaces which are parallel to each other, and wherein a fastener hole extends through the frame in a space between the two second conductor contact surfaces.

14. A ground connector as in claim 9 wherein the first jaw comprises a first section having a conductor contact surface and a second section extending away from the first section at an angle, wherein a first through hole extends through the first and second sections, and wherein the first through hole is configured to have a fastener extend therethrough.

15. A ground connector as in claim 14 wherein the second jaw comprises a first section having a conductor contact surface and a second section extending away from the first section at an angle, wherein a second through hole extends through the first and second sections of the second jaw, wherein the second through hole is configured to have a fastener extend therethrough, and wherein the first and second through holes are substantially parallel to each other.

16. A method comprising:

clamping an electrical ground connector frame to a member with a U-bolt, wherein the frame directly contacts the member; and clamping an electrical conductor against the frame by either a first clamp located opposite a first outwardly facing side of the frame or a second clamp located opposite a second outwardly facing side of the frame, wherein the first and second clamps are connected to the frame by opposite legs of the U-bolt, and wherein the first and second sides are generally orthogonal to each other.

17. A method comprising:

forming a frame having a general V shape with two legs which are angled relative to each other, wherein an inner side of the general V shape is configured to contact another member when the frame is clamped against the member;

providing a U-bolt, wherein opposite legs of the U-bolt are configured to pass through respective ones of the legs of the frame such that the U-bolt and the frame are configured to clamp the member therebetween; and providing first and second clamps configured to be connected to respective ones of the legs of the frame by the opposite legs of the U-bolt, wherein the frame and the first clamp are configured to directly contact and clamp an electrical ground conductor between an outward facing surface of a first one of the legs of the frame and the first clamp, and wherein the frame and the second clamp are configured directly contact and clamp an electrical ground conductor between an outward facing surface of a second one of the legs of the frame and the second clamp.

* * * * *